US010953420B2

(12) United States Patent
Barenhoff et al.

(10) Patent No.: US 10,953,420 B2
(45) Date of Patent: Mar. 23, 2021

(54) PUMP AND DISPENSING DEVICE

(71) Applicant: APTAR DORTMUND GMBH, Dortmund (DE)

(72) Inventors: Swen Barenhoff, Bönen (DE); Detlef Schmitz, Lüdinghausen (DE); Bernhard Jasper, Waltrop (DE)

(73) Assignee: APTAR DORTMUND GMBH, Dortmund (DE)

( * ) Notice: Subject to any disclaimer, the term of this patent is extended or adjusted under 35 U.S.C. 154(b) by 0 days.

(21) Appl. No.: 16/464,804

(22) PCT Filed: Nov. 29, 2017

(86) PCT No.: PCT/EP2017/080842
§ 371 (c)(1),
(2) Date: May 29, 2019

(87) PCT Pub. No.: WO2018/108535
PCT Pub. Date: Jun. 21, 2018

(65) Prior Publication Data

US 2019/0344297 A1 Nov. 14, 2019

(30) Foreign Application Priority Data

Dec. 12, 2016 (DE) ..... 20 2016 007 502.1
Dec. 15, 2016 (DE) ..... 10 2016 014 898.5

(51) Int. Cl.
*B05B 11/00* (2006.01)

(52) U.S. Cl.
CPC ..... *B05B 11/3016* (2013.01); *B05B 11/3023* (2013.01); *B05B 11/3047* (2013.01); *B05B 11/3073* (2013.01)

(58) Field of Classification Search
CPC ..... B05B 11/3016; B05B 11/3023; B05B 11/3047; B05B 11/3073
USPC ..... 222/321.7
See application file for complete search history.

(56) References Cited

U.S. PATENT DOCUMENTS

| | | | |
|---|---|---|---|
| 3,249,259 | A | 5/1966 | Corsette |
| 4,034,900 | A | 7/1977 | Hafele |
| 4,154,374 | A | 5/1979 | Kirk, Jr. |
| 4,941,595 | A | 7/1990 | Montaner et al. |
| 5,437,398 | A | 8/1995 | Ritsche |
| 7,780,044 | B2 | 8/2010 | Leuliet et al. |
| 7,882,988 | B2 | 2/2011 | Nicolle et al. |

(Continued)

FOREIGN PATENT DOCUMENTS

| | | | |
|---|---|---|---|
| DE | 2719242 | A1 | 11/1977 |
| DE | 68904039 | T2 | 4/1993 |

(Continued)

OTHER PUBLICATIONS

International Preliminary Report on Patentability for International Application No. PCT/EP2017/080842, dated Jun. 27, 2019.

(Continued)

*Primary Examiner* — Vishal Pancholi
(74) *Attorney, Agent, or Firm* — Jason H. Vick; Sheridan Ross, PC

(57) ABSTRACT

A pump and a dispensing device with a pump for dispensing a preferably liquid product are proposed, wherein the pump comprises a spring sleeve for a spring, which separates the spring from the product, and/or wherein the pump comprises a sealed spring chamber for a spring.

15 Claims, 4 Drawing Sheets

(56) References Cited

U.S. PATENT DOCUMENTS

| | | | |
|---|---|---|---|
| 7,938,298 | B2 | 5/2011 | Lee |
| 9,073,080 | B2 | 7/2015 | Wochele et al. |
| 9,364,842 | B2 | 6/2016 | Petit |
| 2002/0166876 | A1 | 11/2002 | Masuda |
| 2005/0098583 | A1 | 5/2005 | Mbonyumuhire |
| 2007/0007307 | A1 | 1/2007 | Bohnisch et al. |
| 2007/0272713 | A1 | 11/2007 | Le Maner |
| 2010/0230443 | A1 | 9/2010 | Ding |
| 2013/0112766 | A1 | 5/2013 | Maas et al. |
| 2014/0001213 | A1 | 1/2014 | Petit |
| 2014/0217124 | A1 | 8/2014 | Kim et al. |

FOREIGN PATENT DOCUMENTS

| | | | |
|---|---|---|---|
| DE | 10335842 | B4 | 6/2005 |
| DE | 602004005613 | T2 | 12/2007 |
| DE | 112006003931 | B4 | 5/2010 |
| EP | 0484835 | | 5/1992 |
| EP | 1938903 | A2 | 7/2008 |
| EP | 2688680 | B1 | 8/2015 |
| KR | 10-2006-0052735 | A | 5/2006 |

OTHER PUBLICATIONS

International Search Report (Including translation) for International Application No. PCT/EP2017/080842, dated Feb. 19, 2018.
Written Opinion for International Application No. PCT/EP2017/080842, dated Feb. 19, 2018.
Examination Report for Indian Patent Application No. 201917024039, dated Dec. 23, 2020.

PUMP AND DISPENSING DEVICE

CROSS REFERENCE TO RELATED APPLICATIONS

This application is a national stage application under 35 U.S.C. 371 of PCT Application No. PCT/EP2017/080842 having an international filing date of 29 Nov. 2017 which designated the United States, which PCT application claimed the benefit of German Application No. 20 2016 007 502.1 filed 12 Dec. 2016 and German Application No. 10 2016 014 898.5 filed 15 Dec. 2016, each of which are incorporated herein by reference in their entirety.

SUMMARY

The present invention relates to a pump and a dispensing device according to the claims presented herein.

By the term "dispensing device" is meant in the present invention preferably a device in particular for spraying delivery or dispensing of a preferably liquid product, especially preferably as an aerosol.

A dispensing device in the sense of the present invention preferably comprises a container as a reservoir with a product or for a product, a pump for delivering the product, and a dispensing head for the dispensing of the product to a user, especially by spraying. A dispensing device in the sense of the present invention is preferably manually activatable or comprises a manual or manually activatable pump.

In the present invention, the term "pump" is preferably understood to mean a design arrangement which is configured to deliver a product, especially a fluid. In particular, a product can be suctioned out of a container, pressurized, and/or dispensed as an aerosol, for example, by means of a pump. A pump in the sense of the present invention is preferably designed in particular as a manually activatable displacement pump, especially a dosing pump, especially preferably a reciprocating pump, in particular with a defined volume of the product delivered or able to be delivered by (manual) activation of the pump, especially per each stroke.

A pump in the sense of the present invention preferably comprises a pump piston, a pump chamber, an inlet and an outlet, with the inlet and the outlet preferably able to be opened and closed respectively by an associated valve. In particular, a defined volume of a product can be delivered or suctioned into the pump chamber, placed under pressure in the pump chamber, and dispensed from the pump chamber via the inlet by a stroke movement of the pump piston.

In the sense of the present invention, the term "product" is to be understood in particular as fluids, such as liquids, suspensions, or the like. A product in the sense of the present invention can be dispensed for example as a paste, a jet, or a mist or aerosol, or in some other manner, such as a foam or a gel.

DE 103 35 842 B4 discloses a dispensing device of the kind mentioned above, wherein the dispensing device comprises a pump, a container and a dispensing head. The pump comprises a pump housing, a pump chamber, a pump piston, an inlet valve and an outlet valve. When the dispensing device is activated, the pump piston is forced downward or against the spring force of a spring arranged in the pump housing such that the volume of the pump chamber is reduced and the product in the pump chamber is thus placed under pressure. Thanks to the increased pressure in the pump chamber, the outlet valve opens, so that the product placed under pressure is dispensed via the dispensing head to a user.

The invention is based on the object to provide an improved dispensing device and an improved pump for a dispensing device, especially wherein or whereby a simple, stable, compact and/or cost-effective construction and/or a hygienic delivery or dispensing of the product is made possible or supported and/or the flow control in the pump is improved.

The above object is solved by a pump or a dispensing device according to the claims presented herein. Advantageous modifications are the subject of the subclaims.

The proposed pump preferably comprises a pump housing, a pump piston, a pump chamber and a spring—especially a metallic spring—wherein the pump piston is preferably pretensioned by means of the spring into a starting position or can be moved against the spring force of the spring, especially in order to place the product or a predefined volume of the product in the pump chamber under pressure or to reduce the volume of the pump chamber.

One aspect of the present invention is that the pump comprises a spring sleeve or capsule, preferably around the spring, which is preferably cylindrical and/or separate from or able to be removed from the pump housing, wherein the spring sleeve or capsule preferably completely encloses the spring and/or separates it from the product, especially in such a way that the spring does not come into contact with the product—especially independently of a pump or stroke movement of the pump piston. Especially preferably, the spring sleeve or capsule is designed as a corrosion protection for the spring.

Preferably, the pump chamber extends around the spring sleeve—especially like a ring—and/or the pump chamber is bounded laterally by the spring sleeve and the pump housing, preferably so that the product is or can be conveyed around the spring.

Thanks to such a design, the immediate contact of the spring with the product and a possible reaction of the spring material with the product are avoided. In particular, the spring's risk of corrosion is reduced and/or the corrosion or rusting of the spring, and (thus) the impairment of the product quality, is prevented.

Furthermore, the demands on the material quality of the spring can be reduced. In particular, the spring sleeve eliminates the need to treat the surface of the spring for the protection against corrosion. In this way, an especially cost-effective construction of the pump is made possible or supported.

In addition, such a design prevents the spring from generating (direct) drag for the product. In particular, any turbulence or flow losses that arise due to direct contact between the spring and the product are reduced. The spring sleeve consequently makes possible an especially simple and low-loss flow control in the pump, preferably with no sharp deflections, for example more than 90° or 120°. In this way, the efficiency of the pump is increased.

According to another aspect of the present invention, which may also be realized independently, the pump comprises a sealed or closed spring chamber for the receiving or mounting of the spring, preferably wherein the spring is arranged in the spring chamber and/or the spring chamber is sealed off or closed independently of a stroke movement, especially in such a way that the product does not or cannot flow through the spring chamber. Especially preferably, the spring chamber is filled with a gas, especially air. In this way, corresponding benefits are realized.

Preferably, the spring chamber is formed by the spring sleeve or bounded on the outside or by the pump chamber.

Preferably, the spring sleeve is formed of multiple pieces and/or is telescopic or compressible, especially such that the spring chamber or the spring in the spring chamber is compressible. In this way, it is possible to separate the spring from the product independently of a stroke movement of the pump or the pump piston.

The proposed dispensing device preferably comprises a container, a dispensing head and such a pump. In this way, corresponding benefits are realized.

In principle, the aforementioned aspects and features of the present invention as well as the aspects and features of the present invention emerging from the claims and the following description may be realized independently of each other, but also in any desired combination.

BRIEF DESCRIPTION OF THE DRAWINGS

Further aspects, benefits, features and properties of the present invention will emerge from the claims and the following description of a preferred embodiment with the aid of the drawing. It shows:

DETAILED DESCRIPTION

In the figures, which are sometimes not true to scale and are merely schematic, the same reference numbers are used for the same, identical, or similar parts and components, whereby corresponding or comparable properties and benefits are achieved even if a repeated description is not provided.

Figure 1:
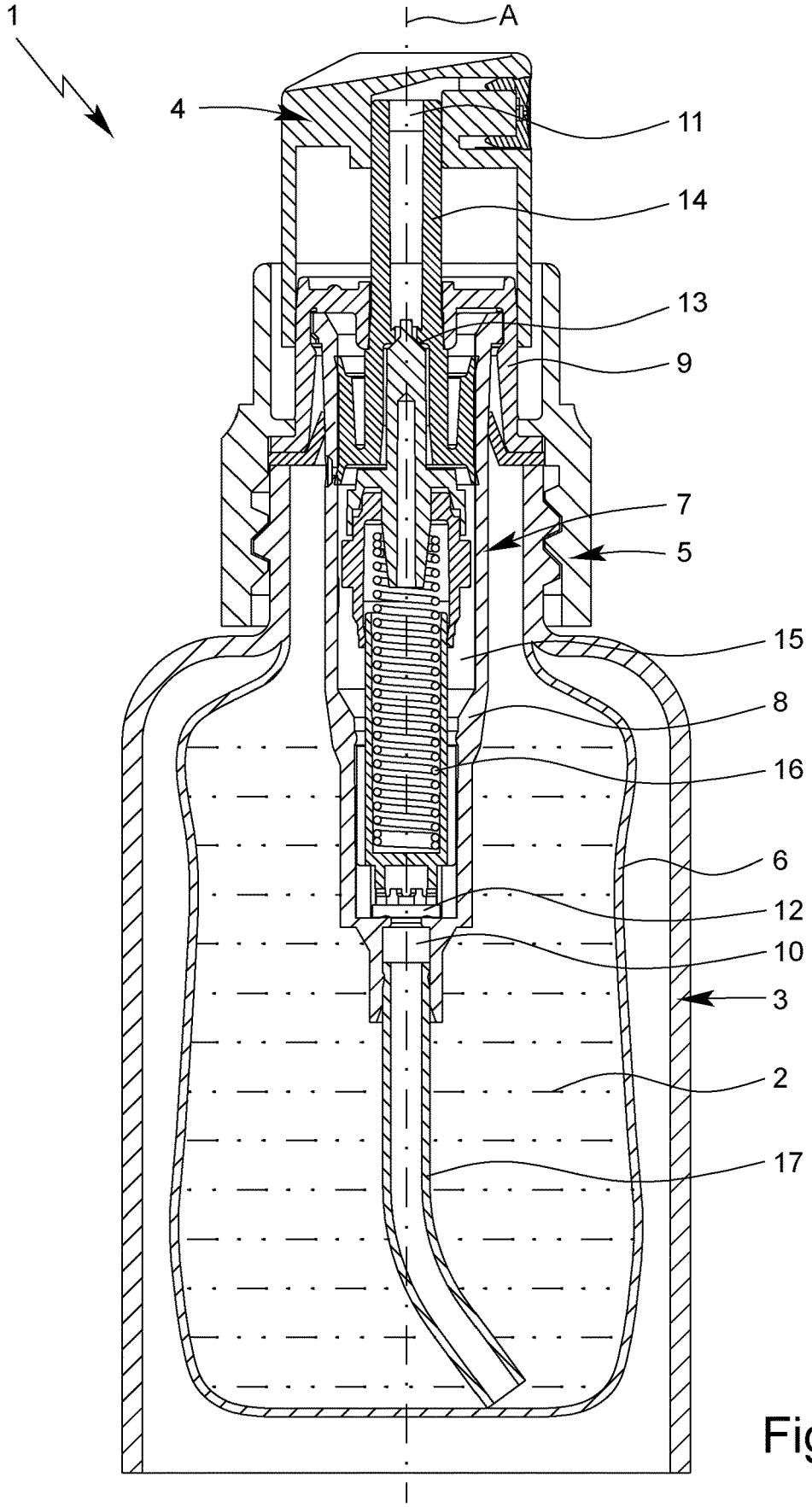
FIG. 1 a schematic section through a proposed dispensing device with a proposed pump in a starting position.

FIG. 1 shows a schematic section through a proposed dispensing device 1 for the dispensing of a product or fluid 2. In the depicted state, the dispensing device 1 is not activated and the dispensing device 1 finds itself in a starting or resting position.

The dispensing device 1 preferably comprises a container 3 with or for the product 2 and/or a dispensing head 4 for the dispensing of the product 2 to a user (not shown).

Preferably, the dispensing head 4 is or can be connected especially mechanically and/or fluidly—to the container 3.

In the embodiment shown, the dispensing device 1 comprises a (separate) closure 5, preferably whereby the dispensing head 4 is or can be connected to the container 3 in a form fitting, force locking and/or integral manner, especially by screwing, via the closure 5. However, solutions are also possible in which the dispensing head 4 comprises or forms the closure 5 and/or the dispensing head 4 is or can be connected immediately or directly to the container 3.

Preferably, the container 3 is configured as a reservoir for the product 2. Especially preferably, the dispensing device 1 or container 3 has a volume of more than 5 mL or 10 mL, especially more than 50 mL or 100 mL, and/or less than 1000 mL or 800 mL, especially less than 600 mL or 500 mL.

The container 3 is preferably elongated, cylindrical and/or rigid in configuration. Especially preferably, the container 3 is made of metal, plastic or glass.

In the embodiment shown, the dispensing device 1 has an optional bag 6, with the bag 6 preferably arranged inside the container 3 and/or containing the product 2.

The optional bag 6 is preferably flexible or elastic. In particular, the bag 6 is compressible, preferably such that the volume of the bag 6 is reduced (accordingly) with the dispensing of the product 2 or each such dispensing. However, other solutions are also possible here.

The dispensing device 1 preferably comprises a pump 7, especially of the kind mentioned above. Especially preferably, the pump 7 is designed as a displacement pump, especially a dosing pump or reciprocating pump.

Figure 2:
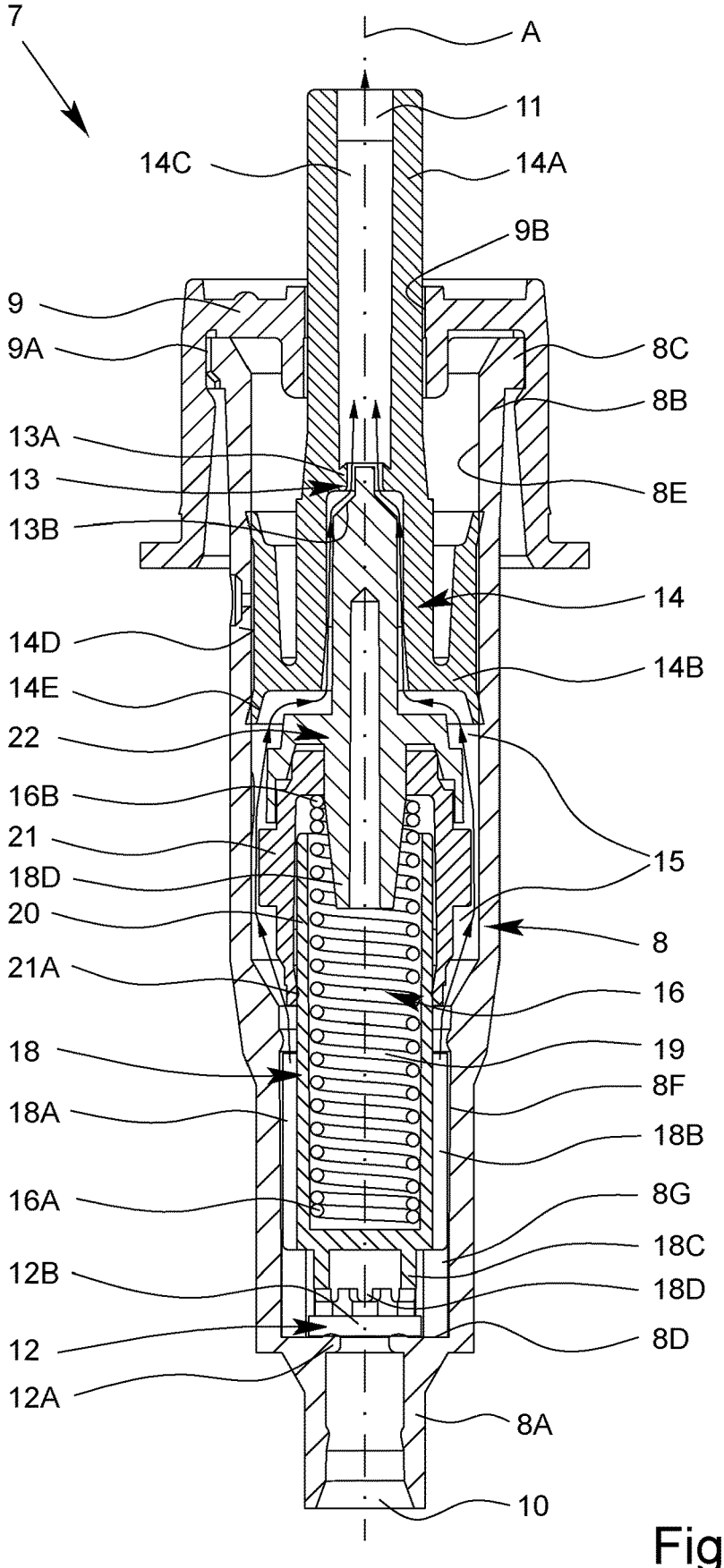
FIG. 2 a schematic section through the pump of FIG. 1 while dispensing a product.
Figure 3:
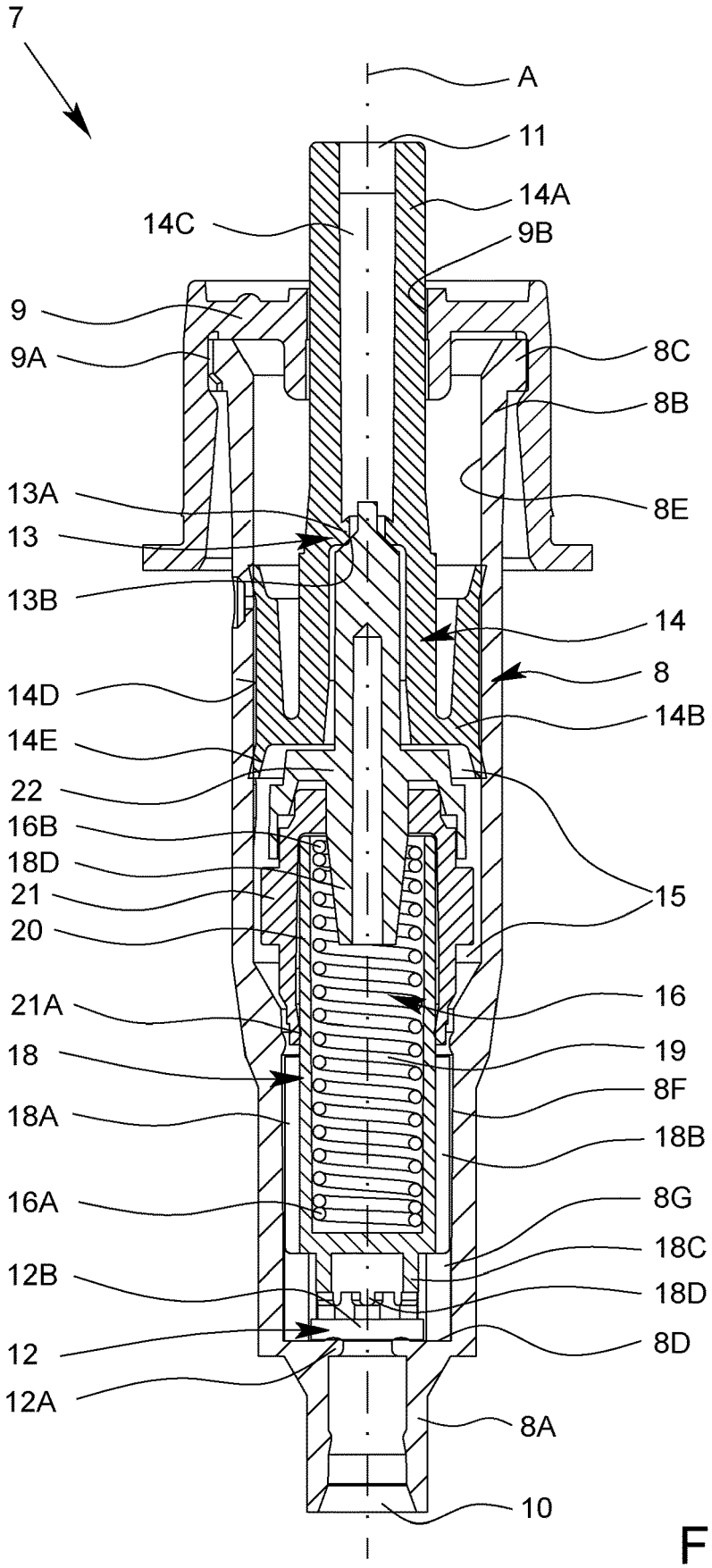
FIG. 3 a schematic section through the pump of FIG. 1 in an end position.
Figure 4:
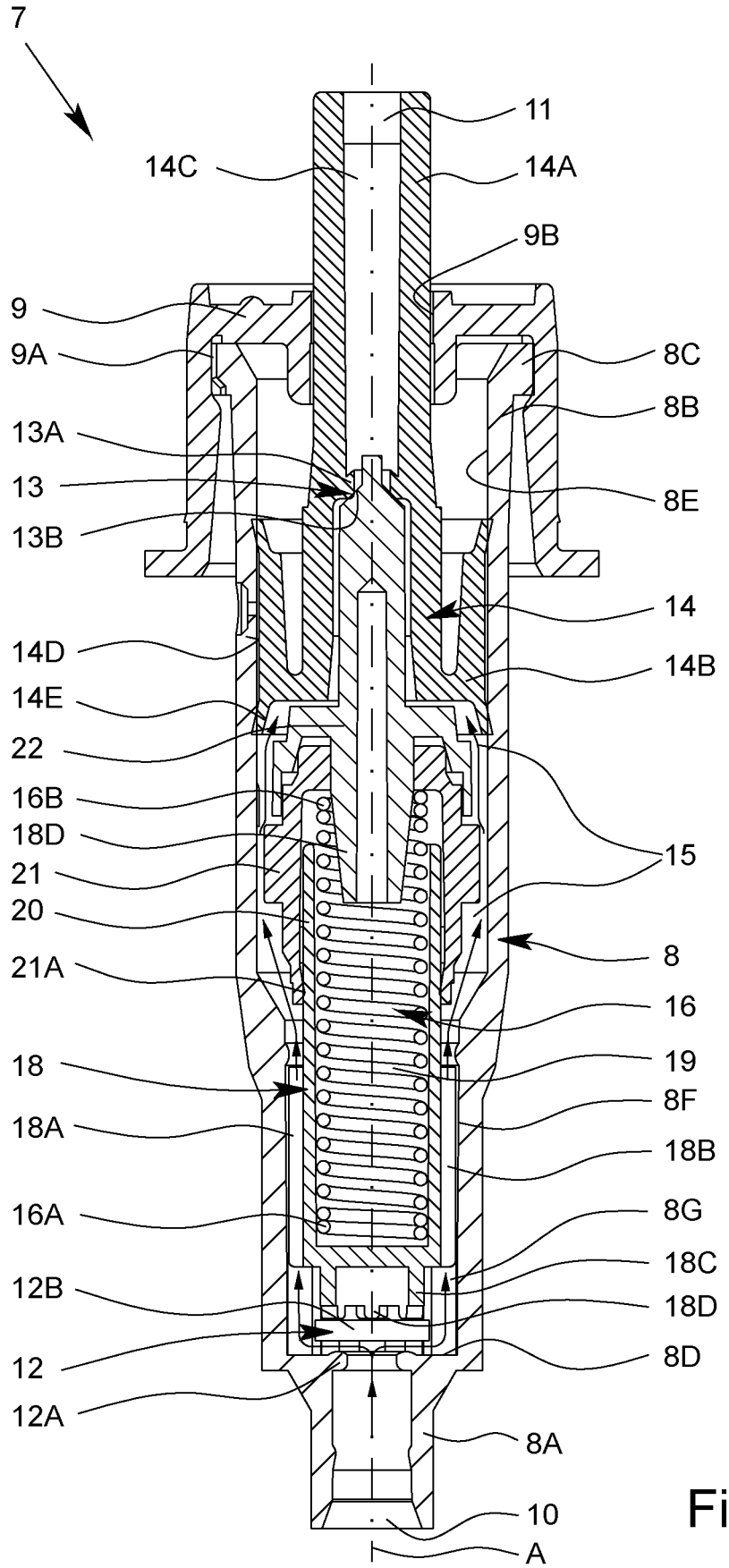
FIG. 4 a schematic section through the pump of FIG. 1 while suctioning the product.

FIG. 2 to FIG. 4 each show a schematic section through the pump 7 in different conditions or positions.

The pump 7 is preferably designed to suction or deliver the product 2, especially a predefined volume of the product 2, from the container 3 or the bag 6, place it under pressure, and/or dispense it under pressure.

Especially preferably, the dispensing head 4 is or can be connected fluidly to the container 3 via the pump 7.

The pump 7 is preferably arranged at least partly in the interior of the container 3. In particular, the pump 7 extends from the dispensing head 4 into the container 3.

Preferably, the pump 7 is or can be connected to the container 3 and/or dispensing head 4 in a form fitting, force locking and/or integral manner.

In the embodiment shown, the pump 7 is fastened via the closure 5 to the container 3 and the dispensing head 4 is mounted on the pump 7. However, other solutions are also possible here—for example, in which the pump 7 is integrated in the dispensing head 4 and/or comprises or forms the closure 5.

The pump 7 preferably comprises a pump housing 8, a housing lid 9, an inlet 10, an outlet 11, an inlet valve 12, an outlet valve 13, a pump piston 14, a pump chamber 15 and/or a spring 16.

Preferably, the pump housing 8, the housing lid 9, the inlet 10, the outlet 11, the inlet valve 12, the outlet valve 13 and/or the pump piston 14, especially preferably all the parts or components of the pump 7—except for the spring 16—is/are made of plastic and/or injection molded.

The pump 7, especially the pump housing 8, is preferably elongated and/or rotationally symmetrical in configuration. In particular, the pump 7 or the pump housing 8 has a longitudinal axis A, preferably the longitudinal axis A is an axis of rotation of the pump 7 or the pump housing 8.

The pump housing 8 is preferably configured in particular as an elongated hollow cylinder.

Preferably, the flow can move through the pump 7 axially or along the longitudinal axis A and/or from the inlet 10 to the outlet 11.

Preferably, the inlet 10 is arranged at a first end of the pump 7, which is the lower end when the dispensing device 1 is positioned as typically used, and the outlet 11 is arranged at a second end of the pump 7, which is the upper end when the dispensing device 1 is positioned as typically used.

Preferably, the inlet 10 and the outlet 11 form the axial ends of the pump 7, in particular with the inlet 10 associated with the container 3 and the outlet 11 with the dispensing head 4.

Preferably, the product 2 or a predefined volume of the product 2 can be taken through the inlet 10 to the pump chamber 15 and/or from the pump chamber 15 through the outlet 11 to the dispensing head 4.

The inlet valve 12 is preferably associated with the inlet 10 and/or arranged between the inlet 10 and the pump chamber 15. Preferably, the outlet valve 13 is associated with the outlet 11 and/or arranged between the outlet 11 and the pump chamber 15.

Preferably, the flow through the pump 7 can be controlled by means of the inlet valve 12 and/or the outlet valve 13.

Preferably, the inlet valve 12 is designed so as to optionally enable or prevent a flow of the product 2 from the container 3 to the pump chamber 15, especially in accordance with the pressure in the pump chamber 15.

Preferably, the outlet valve 13 is designed so as to optionally enable or prevent a flow of the product 2 from the pump chamber 15 to the outlet 11, especially in accordance with the pressure in the pump chamber 15.

Especially preferably, the inlet valve 12 and/or the outlet valve 13 is/are (each) designed as an automatically opening or automatically closing valve, preferably with the inlet valve 12 and the outlet valve 13 opening and closing in accordance with the pressure in the pump chamber 15.

Preferably, the pressure in the pump chamber 15 or the volume of the pump chamber 15 can be changed by activating the dispensing device 1 or pump 7 or by a stroke movement of the pump piston 14.

Especially preferably, the volume of the pump chamber 15 can be reduced by activating the dispensing device 1 or by a movement of the pump piston 14 downward or in the direction of the container 3, and/or the pressure in the pump chamber 15 can be increased by activating the dispensing device 1 or by a movement of the pump piston 14 downward or in the direction of the container 3.

Especially preferably, the outlet valve 13 opens (automatically) when a certain pressure is exceeded in the pump chamber 15 or when the pump chamber 15 is reduced in size by means of the pump piston 14 and/or the outlet valve 13 closes (automatically) when the pressure drop below a certain value in the pump chamber 15 or when the pump chamber 15 is increased in size by means of the pump piston 14.

Especially preferably, the inlet valve 12 opens when the pressure drop below a certain value in the pump chamber 15 or when the pump chamber 15 is increased in size by means of the pump piston 14 and/or the inlet valve 12 closes (automatically) when a certain pressure is exceeded in the pump chamber 15 or when the pump chamber 15 is reduced in size by means of the pump piston 14.

The valves 12, 13 can consequently be opened and closed in accordance with the movement of the pump piston 14—in particular automatically—preferably with the outlet valve 13 and the inlet valve 12 able to be opened and closed contrary to each other or be activated by the movement of the pump piston 14.

Preferably, the inlet valve 12, the outlet valve 13, the pump piston 14, the pump chamber 15 and the spring 16 are at least partly arranged in the pump housing 8 or enclosed by the pump housing 8.

Especially preferably, the inner diameter of the pump housing 8 tapers toward the container 3 or downward in the typical position of use of the dispensing device 1.

Preferably, the pump housing 8 has a first (axial) end 8A situated at the bottom in the typical position of use of the dispensing device 1 and a second (axial) end 8B situated at the top in the typical position of use of the dispensing device 1, preferably with the first end 8A and the second end 8B respectively comprising or forming an (axial) opening of the pump housing 8.

In particular, the pump housing 8, preferably the first end 8A, comprises the inlet 10 or forms this and/or the pump housing 8 tapers in the direction of the container 3 toward the inlet 10.

Especially preferably, the inner diameter of the inlet 10 or that of the first end 8A is less than the inner diameter of the second end 8B.

In the embodiment shown, the inlet 10 is preferably designed as an attachment or nipple for an optional dip tube 17. But other solutions are also possible here.

Preferably, the (internal) components of the pump 7, such as the spring 16 and the pump piston 14, are introduced into or mounted in the pump housing 8 through the second end 8B.

Preferably, the housing lid 9 closes the pump housing 8, in particular the second end 8B, especially preferably in an axial manner.

The housing lid 9 and the pump housing 8 are preferably connected to each other in a form fitting, force locking and/or integral manner. In the embodiment shown, the housing lid 9 is mounted or latched on the pump housing 8, in particular the second end 8B, and/or it is formed as a cap.

Preferably, the pump housing 8 comprises a preferably encircling (radial) protrusion or flange 8C at the second end 8B, with the protrusion or flange 8C preferably engaged in the housing lid 9, in particular in an indentation or groove 9A of the housing lid 9 corresponding to the protrusion or flange 8C.

The pump piston 14 is preferably elongated in shape and/or preferably comprises an elongated piston shaft 14A and/or a piston head 14B—in particular one that is enlarged relative to the piston shaft 14A.

Preferably, the pump piston 14, in particular the piston shaft 14A, projects out from the pump housing 8 or the housing lid 9. Especially preferably, the housing lid 9 has an (axial) opening 9B, preferably with the pump piston 14, in particular the piston shaft 14A, extending through the opening 9B of the housing lid 9 to the outside or to the dispensing head 4.

Preferably, the pump piston 14, in particular the piston shaft 14A, comprises or forms the outlet 11. In particular, the pump piston 14 or the piston shaft 14A comprises an (axial) outlet channel 14C, with the outlet channel 14C emerging into the outlet 11.

As already mentioned in the beginning, the dispensing head 4 is or can be preferably connected to the pump 7 in a form fitting, force locking and/or integral manner. In the embodiment shown, the dispensing head 4 is mounted on the pump 7, in particular the pump piston 14 or the piston shaft 14A. However, other solutions are also possible here.

The pump piston 14 is preferably movable axially or along the longitudinal axis A, in particular so as to suction the product 2 from the container 3 or enlarge the pump chamber 15, to place the suctioned product 2 in the pump chamber 15 under pressure or make the pump chamber 15 smaller, and to dispense it through the outlet channel 14C or the outlet 11 in particular to or through the dispensing head 4.

Preferably, the pump piston 14 is designed to execute a stroke movement in or relative to the pump housing 8. In particular, the pump piston 14 is movable downward or in the direction of the container 3 or inlet 10 by activating or pressing down on the dispensing head 4, in particular in order to make the pump chamber 15 smaller in size or to place the product 2 in the pump chamber 15 under pressure.

Preferably, the piston head 14B has a larger diameter than the piston shaft 14A and/or the pump piston 14 is guided laterally or radially in the pump housing 8 across the piston head 14B.

Preferably, the pump piston 14 or the piston head 14B has a guide surface 14D, especially an encircling one, with the guide surface 14D preferably standing in contact with the inner surface 8E of the pump housing 8 or being movable by sliding along the inner surface 8E of the pump housing 8.

Preferably, the pump piston 14 or the piston head 14B has a seal 14E, especially an encircling one, with the seal 14E preferably standing in contact with the inner surface 8E of the pump housing 8, in particular such that the pump chamber 15 is sealed off from the outside or axially or at the top.

In the embodiment shown, the seal 14E is preferably formed as a single piece with the pump piston 14 or the pump piston 14, in particular the piston head 14B, forms the seal 14E. However, other solutions are also possible here, in particular ones in which the seal 14E is formed as a piston ring and/or is set into an encircling groove on the piston head 14B.

As already explained, the pump 7 preferably comprises at least one spring 16, in particular with the spring 16 being formed as a helical spring and/or being made of metal.

The spring 16 is preferably arranged entirely in the pump housing 8. In particular, the spring 16 is arranged at least substantially in the center of the pump housing 8 and/or coaxially to the pump housing 8 and/or the pump piston 14. However, solutions are also possible in which the spring 16 is arranged off-center in the pump housing 8 and/or set off radially from the longitudinal axis A of the pump housing 8 or the pump piston 14.

Preferably, the spring 16 is buttressed axially in the pump housing 8, especially against the first end 8A of the pump housing 8, as shall be further explained in the following.

Preferably, the spring 16 can be pressed together or compressed by activating the dispensing head 4 or by a movement of the pump piston 14 downward or in the direction of the inlet 10.

The pump piston 14 is preferably pretensioned by means of the spring 16 and/or is movable against the spring force of the spring 16 downward or in the direction of the spring 16, in particular to reduce the volume of the pump chamber 15 or to place the product 2 in the pump chamber 15 under pressure and/or to feed it from the pump chamber 15 through the outlet channel 14C to the outlet 11. The exact sequence of the pumping or stroke movement of the pump piston 14 will be explained more closely in the following with the aid of FIG. 2 to FIG. 4.

One important aspect of the present invention is to separate the spring 16 from the product 2 or to prevent the (direct) contact between the spring 16 and the product 2, in particular independently of a pumping or stroke movement of the pump piston 14.

Preferably, the dispensing device 1 or the pump 7 (for this purpose) comprises a spring sleeve or capsule 18—in particular a removable one with the spring 16 preferably being arranged in the spring sleeve or capsule 18 and/or the spring sleeve or capsule 18 separating the spring 16 from the product 2 or the pump chamber 15 and/or surrounding or being arranged around the spring 16.

In particular, the dispensing device 1 or the pump 7 comprises a preferably closed or sealed spring chamber 19, with the spring 16 preferably being arranged (entirely) in the spring chamber 19 and/or the spring sleeve 18 comprising, forming, or bounding the spring chamber 19—in particular radially and axially.

The spring sleeve 18 is preferably configured as a housing, in particular a closed or sealed one, and/or it is at least substantially rigid. In particular, the spring sleeve 18 is made from plastic or is injection molded.

The spring sleeve 18 or spring chamber 19 is preferably elongated and/or cylindrical. Especially preferably, the inner diameter of the spring sleeve 18 or spring chamber 19 corresponds at least substantially to the outer diameter of the spring 16.

The spring sleeve 18 or spring chamber 19 is preferably filled with a compressible medium, in particular gas, especially preferably air.

Preferably, the spring sleeve 18 or spring chamber 19 is arranged centrally in the pump housing 8 and/or coaxially to the pump housing 8 or the pump piston 14.

Preferably, the pump chamber 15—extends especially preferably as a ring—about the spring sleeve 18 or spring chamber 19, in particular such that a flow around the spring sleeve 18 or spring chamber 19 is possible.

In particular, the pump chamber 15 is bounded laterally or radially by the spring sleeve 18 and by the pump housing 8 and/or the spring sleeve 18 forms an inner wall and the pump housing 8 forms an outer wall of the pump chamber 15.

The pump housing 8 preferably comprises a recess 8F for receiving the spring sleeve 18—in particular in a radial and/or axial manner—with the recess 8F preferably arranged between the inlet 10 or inlet valve 12 on one side and the pump chamber 15 or pump piston 14 on the other.

Preferably, the pump chamber 15 tapers in the direction of the container 3 or downward toward the recess 8F, or the pump chamber 15 has a larger diameter than the recess 8F.

Preferably, the inner diameter of the recess 8F corresponds at least substantially to the outer diameter of the spring sleeve 18 or the lower portion of the spring sleeve 18, in particular such that the spring sleeve 18 sits firmly or at least substantially free of play in the recess 8F of the pump housing 8.

Preferably, the spring sleeve 18 projects out from the recess 8F into the pump chamber 15, and/or the spring sleeve 18 extends from the recess 8F into the pump chamber 15.

Preferably, the spring sleeve 18 comprises—at least at its end or in the region of the recess 8F—a plurality of protrusions 18A, in particular elongated or finlike ones, with the protrusions 18A preferably each extending parallel to the longitudinal axis A on the outside of the spring sleeve 18.

Preferably, the spring sleeve 18 comprises—at least at the end or in the region of the recess 8F—a plurality of guide channels 18B, with the guide channels 18B preferably formed by the protrusions 18A or bounded laterally by the protrusions 18A. In particular, the guide channels 18B connect the pump chamber 15 fluidly to the inlet 10 or inlet valve 12. In this way, the product 2 can flow from the inlet valve 12 into the pump chamber 15. However, other design solutions are also possible, in particular ones in which the pump housing 8 or recess 8F have protrusions and/or indentations in order to enable a flow of the product 2 from the inlet valve 12 to the pump chamber 15.

The pump housing 8, in particular the recess 8F, preferably comprises an (axial) bearing 8G for the spring sleeve 18, with the bearing 8G preferably designed to bear or support the spring sleeve 18 axially, in particular so that the spring force of the spring 16 is or can be absorbed by pump housing 8 via the spring sleeve 18 and the bearing 8G. In the embodiment shown, the bearing 8G is preferably formed by a step or finlike protrusions—in particular around the inlet valve 12.

As already explained, the inlet valve 12 is preferably arranged between the pump chamber 15 and the inlet 10. Especially preferably, the inlet valve 12 is arranged between the lower end of the spring sleeve 18, or the one associated with the inlet 10, and the inlet 10.

Preferably, the inlet valve 12 comprises a valve seat 12A and a valve body 12B, with the valve body 12B preferably movable relative to the valve seat 12A, in particular so as to open and close the inlet valve 12.

In the embodiment shown, the valve seat 12A is preferably formed by the pump housing 8, in particular by a step 8D of the pump housing 8.

Preferably, the valve body 12B can lift off from the valve seat 12A, in particular upon enlargement of the pump chamber 15 or a reduction of pressure in the pump chamber 15, in particular such that the inlet valve 12 opens.

Preferably, the valve body 12B can be lowered onto the valve seat 12A, in particular upon a decrease in size of the pump chamber 15 or an increase of pressure in the pump chamber 15, especially preferably so that the inlet valve 12 closes.

Preferably, the spring sleeve 18 comprises a boundary or an end stop 18C, or the spring sleeve 18 forms a boundary or an end stop 18C for the inlet valve 12, in particular the valve body 12B.

The boundary 18C is preferably designed to limit or restrict the movement of the valve body 12B. Especially preferably, the boundary 18C is formed by one or more—in particular axial—protrusions of the spring sleeve 18.

In the embodiment shown, the boundary 18C is configured as a crown and/or the boundary 18C preferably comprises a plurality of axial teeth or protrusions, with the teeth or protrusions preferably pointing in the direction of the inlet valve 12 or the valve body 12B. Thanks to the teeth or protrusions, the boundary surface or end stop surface for the valve body 12B is reduced, so that the valve body 12B is prevented from sticking to the boundary 18C.

Preferably, the valve body 12B of the inlet valve 12 is configured as a movable plate, with the valve body 12B preferably rising or descending in accordance with the pressure in the pump chamber 15. In particular, the inlet valve 12 opens by the lifting of the valve body 12B from the valve seat 12A in the direction of the spring sleeve 18 or the boundary 18C, in particular when the pressure in the pump chamber 15 drops and/or when the pump piston 14 moves upward.

Other design solutions are also possible, for example ones in which the inlet valve 12 is designed as a membrane valve or the valve body 12B is designed in particular as a flexible membrane, with the spring sleeve 18, in particular the boundary 18C, preferably holding or clamping the valve body 12B, preferably axially, and/or the inlet valve 12 is able to be opened by a deforming, in particular at the margin, or by a lifting of the valve body 12B.

The spring sleeve 18 preferably has a multi-part design and/or is formed by multiple (separate) components or parts.

Preferably, the spring sleeve 18 comprises a base part 20 and a head part 21, preferably with the base part 20 of the dispensing device 1 being situated at the bottom in the typical position of use or in the recess 8F and the head part 21 of the dispensing device 1 being situated at the top in the typical position of use or in the pump chamber 15.

Preferably, the base part 20 forms a lower end of the spring sleeve 18, or an end facing toward the inlet 10, and the head part 21 forms an upper end in the spring sleeve 18, or an end facing toward the outlet 11. In particular, the base part 20 and the head part 2 close the spring chamber 19 entirely, or both axially and radially.

The base part 20 is preferably designed to receive a first lower end 16A of the spring 16 in the typical position of use of the dispensing device 1 and the head part 21 is designed to receive a second upper end 16B of the spring 16 in the typical position of use of the dispensing device.

The spring sleeve 18 is preferably telescopic.

In particular, the spring sleeve 18 and the spring chamber 19 is compressible.

Preferably, the base part 20 and the head part 21 are movable or displaceable relative to each other, in particular in order to increase or decrease the size of the spring chamber 19.

In particular, the base part 20 is mounted immovably relative to the pump housing 8 or fixed in the recess 8F, and/or the head part 21 is movable relative to the pump housing 8 or the base part 20 and/or (axially) movable in the pump chamber 15.

Preferably, the spring sleeve 18 is or the base part 20 and/or the head part 21 is/are designed to be at least substantially rigid. However, other solutions are also possible here, in particular ones in which the spring sleeve 18 is elastically deformable. In particular, the spring sleeve 18 can be made from an elastic, compressible and/or foldable material in order to enable a stroke movement of the pump piston 14.

Preferably, the base part 20 and the head part 21 are inserted into one another and/or the base part 20 and the head part 21 overlap, in particular in the region of the pump chamber 15. In the embodiment shown, the head part 21 is preferably mounted on the base part 20 or the base part 20 extends into the head part 27. However, other solutions are also possible, in particular ones in which the head part 21 is inserted into the base part 20.

Preferably, the spring sleeve 18, in particular the base part 20 and/or the head part 21, comprises a guide or bearing pin 18D, preferably with the pin 18D protruding axially into the spring chamber 19 and/or being designed to hold or to guide the spring 16 or the second end 16B of the spring 16. In particular, the pin 18D is designed to stabilize the spring 16 and/or to prevent a buckling of the spring 16 when the spring 16 or the spring sleeve 18 is compressed.

Preferably, the outer diameter of the head part 21 is smaller than the inner diameter of the pump chamber 15, in particular such that a gap (through which flow is possible) is formed between the head part 21 and the pump housing 8. However, other solutions are also possible, in particular those in which the head part 21 and/or the pump housing 8 preferably comprise(s) finlike protrusions and/or elongated indentations, in order to enable a flow of the product 2 through the pump chamber 15 or from the inlet 10 to the outlet 11.

The head part 21 preferably comprises a seal or sealing lip 21A, especially an encircling one, for the sealing of the spring sleeve 18 or the spring chamber 19. In particular, the seal 21A is designed to seal off the spring chamber 19 against the pump chamber 15.

Preferably, the seal 21A lies radially against the base part 20, in particular such that the seal 21A is pressed (further) against the base part 20 by a pressure increase in the pump chamber 15. This ensures that the spring chamber 19 is sealed off in spite of a pressure increase in the pump chamber 15.

The pump 7 preferably comprises a connection element 22, with the connection element 22 preferably connecting the pump piston 14 (mechanically) to the spring 16 or the spring sleeve 18, in particular the head part 21.

The connection element 22 is preferably elongated and/or preferably extends from the outlet valve 13 into the pump chamber 15.

Preferably, the connection element 22 and the pump piston 14 form the outlet valve 13, in particular with the pump piston 14 comprising or forming the valve seat 13A and the connection element 22 comprising or forming the valve body 13B of the outlet valve 13.

Especially preferably, the connection element 22 tapers upward or in the direction of the dispensing head 4 toward the valve body 13B and/or the connection element 22 has a conical or cone-shaped end, which comprises or forms the valve body 13B or a valve cone as the valve body 13B.

Preferably, the connection element 22 and the spring sleeve 18, in particular the head part 21, are firmly joined together, preferably by form fitting and/or force locking. In the embodiment shown, the connection element 22 and the head part 21 are formed as separate parts. However, other solutions are also possible here, in which the head part 21 and the connection element 22 are formed as a single piece or form a single unit.

Preferably, the connection element 22 is made of plastic or injection molded.

Preferably, the connection element 22 extends into the spring sleeve 18 or through the head part 21 and into the spring chamber 19.

In the embodiment shown, the connection element 22 comprises the pin 18D and/or the connection element 22, in particular a lower end of the connection element 22 associated with the spring sleeve 18, forms the pin 18D. However, solutions are also possible here in which the head part 21 comprises or forms the pin 18D.

Preferably, the connection element 22—in particular after exceeding a predetermined pressure in the pump chamber 15 or by activating the dispensing device 1 or the dispensing head 4—is movable downward relative to the pump piston 14 in the typical position of use of the dispensing device 1, preferably in order to open the outlet valve 13 or to lift the valve body 13B from the valve seat 13A and/or to feed the product 2 from the pump chamber 15 to the outlet 11.

Especially preferably, the connection element 22 and the head part 21 can be moved together against the spring force of the spring 16, in order to open the outlet valve 13 and enable a dispensing of the product 2 from the pump chamber 14.

In the following, the movement sequence of the dispensing device 1 and the pump 7 will be explained more closely.

FIG. 1 shows the dispensing device 1 and the pump 7 in the non-activated state or in a starting position. FIG. 2 shows the pump 7 during the activation or the dispensing of the product 2. FIG. 3 shows the pump 7 in a final position, in which the pump piston 14 or connection element 22 has been moved entirely downward or in the direction of the inlet 10. FIG. 4 shows the pump 7 upon the return of the pump piston 14 to the starting position or during the suctioning or filling of the pump chamber 5 with the product 2.

The starting or resting position of the dispensing device 1 or the pump 7 is preferably the position which the pump 7, and in particular the pump piston 14 or the head part 21 or the connection element 22, assumes in the non-activated state and/or automatically or due to the spring force of the spring 16. In the starting position, the volume of the pump chamber 15 is at maximum and/or the spring 16 presses the pump piston 14, the head part 21 and/or the connection element 22 upward or against the pump housing 8 or the housing lid 9.

Preferably, the starting position or a movement of the pump piston 14 beyond the starting position is limited (axially or upward) by the striking of the pump piston 14, in particular the piston head 14B, against the pump housing 8 or the housing lid 9.

The final position is preferably the position which the pump 7, and in particular the pump piston 14 or the head part 21 or the connection element 22, assumes upon complete activation of the pump 7. In particular, the pump piston 14 or the head part 21 or the connection element 22 in the final position is moved or forced fully downward or in the direction of the inlet 10. In the final position, the volume of the pump chamber 15 is minimal and/or is less than in the starting position.

Preferably, the final position or a movement of the pump piston 14 beyond the final position is limited (axially or downward) by the striking of the connection element 22 or head part 21 against the base part 20 and/or the pump housing 8.

Preferably, the pump 7 can be transferred from the starting position, as shown in FIG. 1, to the final position, as shown in FIG. 3, by (manual) activation of or pressing down on the dispensing head 4.

Preferably, the spring 16 is designed to transfer the pump 7, in particular by means of spring force or automatically, from the final position to the starting position. In particular, the spring 16 brings about an automatic return of the pump 7 or the pump piston 14 to the starting position after the activation of the pump 7.

The pump piston 14 or connection element 22 or head part 21 is/are preferably pretensioned in the starting position by means of the spring 16. In particular, the spring 16 presses the head part 21 or connection element 22 or pump piston 14 against the pump housing 8 or housing lid 9.

By activating the dispensing device 1 or the dispensing head 4, the pump piston 14, in particular together with the head part 21 or connection element 22, is movable downward or in the direction of the container 3 against the spring force of the spring 16 or into the typical position of use, preferably so that the volume of the pump chamber 15 is reduced in size and/or the pressure in the pump chamber 15 is increased, as already explained.

Thanks to the decrease in the volume of the pump chamber 15 or thanks to the pressure increase in the pump chamber 15, the inlet valve 12 is (automatically) closed and/or the valve body 12B is pressed against the valve seat 12A, particularly in such a way that the product 2 in the pump chamber 15 cannot flow back into the container 3.

Upon activating the dispensing device 1 or the dispensing head 4 or the pump 7, the head part 21 is moved preferably relative to the base part 20 and/or the spring chamber 19 is reduced in size and/or the gas pressure in the spring chamber 19 is increased.

Preferably, the spring sleeve 16 or the spring chamber 19 is configured such that no gas or no air escapes from the spring chamber 19—even given or in spite of a pressure increase by compression of the spring chamber 19—into the pump chamber 15.

As already explained, the outlet valve 13 is designed to open automatically when a predetermined pressure in the pump chamber 15 is exceeded. In particular, a pressure increase in the pump chamber 15 or an activating of the dispensing device 1 or dispensing head 4 or pump 7 results in the valve body 13B or the connection element 22 moving relative to the valve seat 13A or pump piston 14 or lifting from the valve seat 13A or pump piston 14, preferably in such a way that the outlet valve 13 opens and/or the product 2 can flow from the pump chamber 15 through the outlet valve 13 into the outlet channel 14C of the pump piston 14, as indicated in FIG. 2 by arrows.

The opening of the outlet valve 13 brings about a pressure drop in the pump chamber 15, preferably so that the outlet valve 13 would close again without further activation of the dispensing device 1. Thanks to a continuous activation of the dispensing device 1 or the dispensing head 4 or the pump 7, however, the volume of the pump chamber 15 is further reduced or the product 2 in the pump chamber 15 is placed under pressure, preferably in such a way the outlet valve 13 remains open until the final position is reached, as shown in FIG. 3.

After or upon reaching the final position, the dispensing process is completed and/or the outlet valve 13 closes, in particular because the pump housing 8 and/or the base part 20 presses the valve body 13B or the connection element 22 or the head part 21 against the valve seat 13A or the pump piston 14.

In the embodiment shown, as illustrated in particular in FIG. 3, the downward movement of the pump piston 14 or the head part 21 or the connection element 22 is bounded by the fact that the head part 21 strikes against the axial end of the base part 20. However, other solutions are also possible here, in particular ones in which the pump housing 8 comprises or forms an end stop for the head part 21, the connection element 22 and/or the pump piston 14.

After dispensing the product 2 or by releasing the dispensing head 4, an automatic filling of the pump chamber 15 preferably occurs.

As soon as the dispensing head 4 is released, the spring 16 presses the pump piston 14 or the head part 21 or the connection element 22 upward once again or in the direction of the dispensing head 4 or into the starting position.

Thanks to the return of the pump 7, in particular of the pump piston 14 or head part 21 or connection element 22, from the final position to the starting position, the volume of the pump chamber 15 is increased and/or the pressure is reduced because of the increase in volume of the pump chamber 15, preferably with the result that the inlet valve 12 opens or the valve body 12B is lifted from the valve seat 12A, as shown in FIG. 4.

Thanks to the movement of the pump piston 14 from the final position to the starting position or upward into the typical position of use of the dispensing device 1, a predefined volume of the product 2 is suctioned or delivered from the container 3 through the optional dip tube 17 or the inlet 10 and/or the inlet valve 12 to the pump chamber 15.

Together with the movement of the pump piston 14 into the starting position, the volume of the spring chamber 19 also increases and/or the head part 21 moves relative to the base part 20 or upward.

As indicated by arrows in FIG. 4, the product 2 flows, upon returning of the pump piston 14 into the starting position, through the inlet valve 12 laterally past the spring sleeve 18 and into the pump chamber 15, in particular without thereby coming into (direct) contact with the spring 16.

Because the spring 16 is pressing the head part 21 or the connection element 22 against the pump piston 14, the outlet valve 13 is or remains closed during the (entire) movement of the pump piston 14 upward or into the starting position.

Once the starting position is attained, the filling of the pump chamber 15 is completed. By once again activating the dispensing device 1 or the dispensing head 4, the product 2 located in the pump chamber 15 can then be dispensed, as already explained.

The proposed dispensing device 1 or pump 7 makes it possible for the spring 16 to be separated from the product 2—in particular independently of a pumping or stroke movement of the pump 7—and/or for the spring chamber 19 to be sealed off—in particular independently of a pumping or stroke movement of the pump 7.

Consequently, the direct contact between the spring 16 and the product 2 and (hence) a possible reaction of the material of the spring 16 with the product 2 is avoided. In particular, a rust formation in the pump 7 and (hence) a possible contamination of the product 2 is prevented or at least reduced.

Individual aspects and features of the present invention may be realized independently of each other, but also in any desired combination and/or sequence.

| List of Reference Symbols: | |
|---|---|
| 1 | Dispensing device |
| 2 | Product/Fluid |
| 3 | Container |
| 4 | Dispensing head |
| 5 | Closure |
| 6 | Bag |
| 7 | Pump |
| 8 | Pump housing |
| 8A | First end |
| 8B | Second end |
| 8C | Protrusion |
| 8D | Step |
| 8E | Inner surface |
| 8F | Recess |
| 8G | Bearing |
| 9 | Housing lid |
| 9A | Groove |
| 9B | Opening |
| 10 | Inlet |
| 11 | Outlet |
| 12 | Inlet valve |
| 12A | Valve seat |
| 12B | Valve body |
| 13 | Outlet valve |
| 13A | Valve seat |
| 13B | Valve body |
| 14 | Pump piston |
| 14A | Piston shaft |
| 14B | Piston head |
| 14C | Outlet channel |
| 14D | Guide surface |
| 14E | Seal |
| 15 | Pump chamber |
| 16 | Spring |
| 16A | First end |
| 16B | Second end |
| 17 | Dip tube |
| 18 | Spring sleeve |
| 18A | Protrusion |
| 18B | Guide channel |
| 18C | Boundary |
| 18D | Pin |
| 19 | Spring chamber |
| 20 | Base part |
| 21 | Head part |
| 21A | Seal |
| 22 | Connection element |
| A | Longitudinal axis |

The invention claimed is:

1. A pump configured for a liquid product, the pump comprising a pump housing, a pump piston, a pump chamber, a spring, an inlet, an outlet, an inlet valve and an outlet valve, wherein the pump piston, the pump chamber, the spring, the inlet valve and the outlet valve are arranged at least partly in the pump housing, wherein the pump piston is axially movable in the pump housing in order to deliver the product through the inlet into the pump chamber and from the pump chamber to the outlet, wherein the pump piston is pretensioned by means of the spring into a starting position and is movable against the spring force of the spring into a final position in order to pressurize the product in the pump chamber, wherein the inlet valve is arranged between the inlet and the pump chamber, and with at least one of the following features:

the pump has a spring sleeve around the spring, wherein the spring sleeve separates the spring from the product and wherein the pump chamber extends around the spring sleeve in a ring so that the product can flow around the spring sleeve; and/or the pump has a sealed spring chamber for the spring, wherein the spring is arranged in the spring chamber and wherein the pump chamber extends around the spring chamber in a ring so that the product can flow around the spring chamber.

2. The pump according to claim 1, wherein the pump chamber is bounded laterally by the spring sleeve and the pump housing.

3. The pump according to claim 1, wherein the spring sleeve seals off the spring chamber or bounds it laterally.

4. The pump according to claim 1, wherein the spring sleeve encloses the spring entirely.

5. The pump according to claim 1, wherein the spring sleeve separates the spring from the product independently of a pumping movement.

6. The pump according to claim 1, wherein the spring chamber is sealed off independently of a pumping movement.

7. The pump according to claim 1, wherein the spring sleeve is formed of multiple pieces and/or is telescopic or compressible.

8. The pump according to claim 1, wherein the spring chamber is compressible.

9. The pump according to claim 1, wherein the pump has a connection element, which mechanically connects the pump piston to the spring sleeve or the spring.

10. The pump according to claim 9, wherein the connection element and the pump piston form the outlet valve and/or wherein the connection element, after a predetermined pressure is exceeded in the pump chamber, is movable relative to the pump piston in order to open the outlet valve and/or to dispense the product through the outlet.

11. The pump according to claim 1, wherein the spring sleeve comprises a base part and a head part.

12. The pump according to claim 9, wherein the pump has a connection element, which mechanically connects the pump piston to the spring sleeve or the spring, and wherein a head part of the spring sleeve and the connection element are formed as a single piece or form a single unit and/or are joined together firmly and/or are biased together by means of the spring into the starting position or are movable against the spring force of the spring.

13. The pump according to claim 11, wherein the base part and the head part are movable relatively or telescopically to each other and/or the head part is sealed off and connected to the base part.

14. The pump according to claim 1, wherein the inlet valve opens automatically upon enlargement of the pump chamber or upon a movement of the pump piston from the final position to the starting position.

15. A dispensing device configured to dispense a liquid product, the dispensing device comprising a dispensing head, a pump and a container with or for the product, wherein the dispensing head is connected fluidly through the pump to the container, wherein the pump comprises a pump housing, a pump piston, a pump chamber, a spring, an inlet, an outlet, an inlet valve and an outlet valve, wherein the pump piston, the pump chamber, the spring, the inlet valve and the outlet valve are arranged at least partly in the pump housing, wherein the pump piston is axially movable in the pump housing in order to deliver the product through the inlet into the pump chamber and from the pump chamber to the outlet, wherein the pump piston is pretensioned by means of the spring into a starting position and is movable against the spring force of the spring into a final position in order to pressurize the product in the pump chamber, wherein the inlet valve is arranged between the inlet and the pump chamber, and with at least one of the following features:

the pump has a spring sleeve around the spring, wherein the spring sleeve separates the spring from the product and wherein the pump chamber extends around the spring sleeve in a ring so that the product can flow around the spring sleeve; and/or the pump has a sealed spring chamber for the spring, wherein the spring is arranged in the spring chamber and wherein the pump chamber extends around the spring chamber in a ring so that the product can flow around the spring chamber.

* * * * *